US009604810B2

(12) United States Patent
Jendroska et al.

(10) Patent No.: US 9,604,810 B2
(45) **Date of Patent: *Mar. 28, 2017**

(54) ROLL HANDLING SYSTEM FOR A WINDER COMPRISING A RECEIVING UNIT HAVING POSITIONING MEANS AND A METHOD THEREFOR

(71) Applicant: Windmöller & Hölscher KG, Lengerich (DE)

(72) Inventors: Rainer Jendroska, Ladbergen (DE); Tristan Zesiger, Osnabrück (DE)

(73) Assignee: Windmöller & Hölscher KG, Lengerich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/890,592

(22) PCT Filed: Feb. 26, 2014

(86) PCT No.: PCT/EP2014/053755

§ 371 (c)(1),
(2) Date: Nov. 12, 2015

(87) PCT Pub. No.: WO2014/183888

PCT Pub. Date: Nov. 20, 2014

(65) Prior Publication Data

US 2016/0114996 A1 Apr. 28, 2016

(30) Foreign Application Priority Data

May 13, 2013 (DE) ..... 10 2013 104 909
Aug. 15, 2013 (DE) ..... 10 2013 108 830

(51) Int. Cl.
*B65H 19/30* (2006.01)

(52) U.S. Cl.
CPC ... *B65H 19/305* (2013.01); *B65H 2301/4148* (2013.01); *B65H 2301/4149* (2013.01)

(58) Field of Classification Search
CPC ..... B65H 19/2284; B65H 19/30; B65H 2301/4148; B65H 2301/41496;
(Continued)

(56) References Cited

U.S. PATENT DOCUMENTS 2,198,644 A * 4/1940 Wettengel ..... B21C 47/24 193/36
3,424,398 A 1/1969 Garnier
(Continued)

FOREIGN PATENT DOCUMENTS

DE 1604659 12/1970
DE 2654707 6/1978
(Continued)

OTHER PUBLICATIONS

International Search Report and the Written Opinion Dated May 27, 2014 From the European Patent Office Re. Application No. PCT/EP2014/053755 and Its Translation of Search Report Into English.
(Continued)

*Primary Examiner* — William A Rivera

(57) ABSTRACT

The invention relates to a roll handling system for a winder (50) in which cores (1) are applicable each with a material web (2) so that a plurality of rolls (3) consisting of cores (1) wound with the material web (2) are produced with a supply unit (10) in order to transfer a plurality of cores (1) to a receiving unit (20), wherein the receiving unit (20) is movably assembled between the supply unit (10) and a transfer station (60) with which cores (1) are transferable to the winder (50) and rolls (3) are transferable from the winder (50) to the transfer station (60). According to the invention the receiving unit (20) comprises a first contact surface (23) with positioning means (24) in order to align the core (1) at
(Continued)

the receiving unit (20) via a positioning device (80) assembled between the supply unit (10) and the transfer station (60).

20 Claims, 14 Drawing Sheets

(58) Field of Classification Search
CPC .... B65H 2301/4172; B65H 2301/4173; B65H 2301/41734; B65H 2301/41745; B65H 2301/41814; B65H 2301/41818; B65H 2301/41828; B65H 2301/41816; B65H 2408/23152; B65H 2405/422; B65H 19/305; B65H 2301/4149
See application file for complete search history.

(56) References Cited

U.S. PATENT DOCUMENTS 3,718,303 A * 2/1973 Mount ..... B21C 47/24 242/533
3,727,853 A * 4/1973 Kinoshita ..... B29C 53/32 242/532.3
4,208,019 A * 6/1980 Dusenbery ..... B65H 19/2284 242/527.2
5,352,319 A * 10/1994 Ishizu ..... B65H 19/22 156/184
5,759,326 A * 6/1998 Vigneau ..... B65H 19/29 156/187
5,941,474 A * 8/1999 Cushing ..... B65H 19/2215 242/530.1
9,346,651 B2 * 5/2016 Ludwig ..... B65H 67/0411
2007/0246595 A1 * 10/2007 Tsai ..... B65H 19/2269 242/532.3
2010/0025516 A1 * 2/2010 Barsacchi ..... B25J 15/0616 242/533.2
2011/0011971 A1 * 1/2011 Thepaut ..... B65H 19/305 242/473.5
2016/0083212 A1 * 3/2016 Jendroska ..... B65H 19/305 242/533.7
2016/0114996 A1 * 4/2016 Jendroska ..... B65H 19/305 242/533.7

FOREIGN PATENT DOCUMENTS

| | | |
|---|---|---|
| DE | 2847556 | 2/1980 |
| EP | 0360948 | 4/1990 |
| GB | 2028772 | 3/1980 |
| WO | WO 03/010079 | 2/2003 |
| WO | WO 2014/183888 | 11/2014 |

OTHER PUBLICATIONS

Pruefungsantrag [Examination Report] Dated Jan. 17, 2014 From the Deutsches Patent—und Markenamt [German Patent and Trademark Office] Re. Application No. 102013108830.9 and Its Translation Into English.

* cited by examiner

ROLL HANDLING SYSTEM FOR A WINDER COMPRISING A RECEIVING UNIT HAVING POSITIONING MEANS AND A METHOD THEREFOR

RELATED APPLICATIONS

This application is a National Phase of PCT Patent Application No. PCT/EP2014/053755 having International filing date of Feb. 26, 2014, which claims the benefit of priority of German Patent Applications Nos. 10 2013 104 909.5 filed on May 13, 2013 and 10 2013 108 830.9 filed on Aug. 15, 2013. The contents of the above applications are all incorporated by reference as if fully set forth herein in their entirety.

FIELD AND BACKGROUND OF THE INVENTION

The invention relates to a roll handling system for a winder in which a material web can be applied to cores such that a plurality of rolls consisting of cores wound with the material web are produced. Further, the invention relates to a method for said roll handling system.

From the document WO 03/010079A1 a device is known with which in a winder a material web can be applied to a rotating core. A roll results consisting of cores wound with the material web, which are transported away from the winder via a roll handling system. A main disadvantage in the state of the art is that the roll handling system is only possible to process or to move one core or one roll respectively. Further, it has turned out as a disadvantage that in the state of the art said devices are constructionally elaborate.

SUMMARY OF THE INVENTION

The object of the present invention is to avoid previously described disadvantages, particularly to establish a roll handling system for a winder and a method therefor, so that the productivity of the overall construction and the method are significantly improved.

The object of the present invention is solved by a roll handling system with all features of claim 1. Further, said object is solved by a method with all features of claim 15. In the respective dependent claims possible embodiments of the invention are described.

According to the invention a roll handling system for a winder is intended in which cores are applicable, each with a material web, so that the plurality of rolls consisting of cores wound with the material web are produced with a supply unit in order to transfer a plurality of cores to a receiving unit, wherein the receiving unit is movably mounted between the supply unit and the transfer station with which cores are transferable to the winder and rolls are transferable from the winder to the transfer station, wherein the receiving unit comprises a first contact surface with positioning means in order to align the cores at the receiving unit using a positioning device assembled between the supply unit and the transfer station. An essential advantage of the invention is that the plurality of cores can be processed in the roll handling system by which among others the material web can be applied and therewith a plurality of rolls results, whereby the productivity of the overall construction can be significantly improved. Due to the processing of a plurality of cores or rolls at the same time the present invention comprises a receiving unit with positioning means in order to ensure an appropriate alignment of the cores at the transfer station. It has turned out that the correct application of the material web at the cores has to be ensured so that the exact positioning of the cores within the transfer station is necessary. Only in this way a high quality during the application of the material web to the single cores in the winder can occur. Since a plurality of cores has to be transported in the winder, the positioning means at the first contact station during the movement of the receiving unit in the direction to the transfer station serves for the fact that the cores are turned into their exact position. According to the invention a positioning of the cores occurs during the movement of the receiving unit in the direction of the transfer station. Hereby, the positioning device positions the cores at the moving receiving unit. In case the neighboring cores are already in the transfer station, it is according to the invention not further necessary to readjust or correct the position of the cores. Without losing time a transfer of the cores to the winder from the transfer station can occur.

In a further measure improving the invention it can be intended that the first contact surface comprises bowl elements which are at least partially adjusted to the geometric form of the cores, wherein particularly the bowl elements are spaced apart to one another. The bowl elements which are generated by the first contact surface at their surface can advantageously be configured from a metallic material. The surface of the first contact surface is advantageously adjusted to the geometry of the cores. The cores comprise advantageously a hollow, cylindrical form with a defined diameter. The bowl elements can be positioned to one another in a spaced apart manner, wherein at the bowl element at least one positioning means is assembled. Advantageously, the positioning device is configured in a way that the positioning of the cores to one another occurs at the first contact surface of the receiving unit. During the positioning for example the distance to the neighboring cores can be corrected and adjusted accordingly, wherein at the same time each core is positioned at the receiving unit accordingly via the positioning device and the positioning means. Hereby an automatic roll exchange can be generated which is not time consuming. At the same time the machine speeds, particularly at the winder, can be increased wherein the productivity can be improved.

Advantageously the positioning means can extend protrusion-like from the bowl element and/or from the contact surface. Advantageously, the cores are adjusted transversely to the first contact surface after the supply to the receiving unit since the cores are each assembled on a positioning means which for example extends protrusion-like from the contact surface. During the positioning using the positioning device, the positioning device contacts at least one or multiple cores, which move in the direction of the transfer station via movable receiving units, wherein at the same time the core is pushed away from the positioning means and an even resting of the cores with the first contact surface results. For example it is possible that the positioning means are disk-like, particularly are configured as metallic disks. The cores can for example be configured from plastic, wherein the weight of each roll or core can be reduced. Further, hereby hardly any noise results when the cores bump against the respective positioning means.

In a further measure improving the invention the roll handling system according to the invention can be configured in a way that the positioning means are assembled laterally at the bowl element. The lateral assembly of the positioning means results among others from the easy assembly. For example the positioning means can be assembled laterally at the respective bowl element in a formand/or force-fitting manner, particularly via a screw connection. An exchange of the positioning means is likewise possible.

Further the roll handling system according to the invention can be configured with a second contact surface of the receiving unit in order to take up the rolls, particularly that the second contact surface is movable independently from the receiving unit. Hereby in can be meaningful to provide two different contact surfaces at the receiving unit, since the to be transported geometry of the cores and the rolls can be or is different. Likewise it can be an advantage that the second contact surface can be moved independently from a movement of the receiving unit, for example when the winder transfers the rolls to the transfer station. Hereby it is possible that the second contact surface is moved via a lift drive in order to securely receive the winding shaft with the rolls.

Further the invention comprises that the receiving unit is linear movable between the supply unit and the transfer station and/or comprises a lifting device, wherein the receiving unit is movable between the supply unit and the transfer station perpendicular to the movement direction. The lifting device can be configured in a way that not only the first but also the second contact surface are moved along. Likewise it is possible that the first and/or the second contact surface comprise an independent lifting device. Further the invention comprises that the receiving unit can comprise a travel during the movement in the direction of the transfer station and back, which can be more complex than a linear movement, for example the travel can occur in an arch and/or on a circular part.

Further it can be an advantage that the receiving unit is assembled rotatable about an axis. According to the rotating position of the receiving unit the first or the second contact surface is provided for the roll handling system. Such a configuration of the rotating receiving unit supports a compact overall construction of the roll handling system.

Further it can be an advantage that the receiving unit comprises a guiding element which can be applied between an active and passive position, wherein during the movement of the receiving unit in the direction of the transfer station the guidance element can be travelled from the passive position into the active position in order to bring a winding shaft into position assembled at the transfer station, particularly that the guidance element contacts the winding shaft in the active position and/or moves the winding shaft in a defined position. In a measure improving the invention the transfer station can comprise a holding device at which the winding shaft is detachably assembled wherein the cores can be positioned on the winding shaft during the movement of the receiving unit in the direction to the transfer station. In case the cores are completely applied to the winding shaft in the proper state the holding device releases the fixation at the winding shaft which can subsequently be supplied to the winder. Further, the winding shaft with the positioned rolls can be transferred back to the transfer station wherein the holding device refixes the fixation with the winding shaft subsequent to the transfer so that the rolls can be transported back to a roller guidance via a movement of the receiving unit. In order to make it possible that the rolls can be positioned on the winding shaft and/or the rolls can be transported away from the winding shaft in the direction of the roller away guidance in a simple manner, the winding shaft is mounted and/or assembled at the holding device at one side. Particularly the mounting of the winding shaft is assembled at the side of the holding device facing away from the supply unit.

The guidance element according to the invention, which can be applied between an active and a passive position, serves for the fact that during the positioning of the cores on the winding shaft, the winding shaft comprises the desired horizontal and/or vertical state. During the movement of the receiving unit from the transfer station in the direction of the supply unit the guidance element can be in its active position and therewith directly contact the winding shaft in order to hold the shaft in the desired position. Advantageously, the guidance element comprises a roll element which rolls at the active position of the winding shaft. The roll element is adjusted according to the geometry of the winding shaft. Advantageously, the roll element is configured from plastic wherein the wear, the weight and the noise pollution can be minimized.

Advantageously the positioning device can be configured in a way that the positioning of the cores to one another occurs. During the positioning the distance to the neighboring cores can be corrected and adjusted accordingly, wherein at the same time each core is positioned at the receiving unit accordingly via the positioning device.

Further it can be intended that the positioning device comprises a stripper element which serves for the contact with at least one core during the movement of the receiving unit in the direction of the transfer station. Hereby, the positioning device is movable wherein particularly during the movement of the receiving unit with the cores into the direction of the transfer station the positioning device takes up a working position. During the movement of the receiving unit with the rolls advantageously the positioning device takes up a waiting position which differs from the working position. The stripper element contacts the cores during the movement of the receiving unit in the direction of the transfer station and turns these into a correct position at the receiving unit. Advantageously the stripper element is assembled immovably at the positioning device during the positioning of the cores at the receiving unit. Expediently the stripper element projects at least partially in the travel of the cores in the direction of the transfer station so that automatically one or all cores hit the stripper element and are therewith positioned in the receiving unit. During the movement of the receiving unit in the direction of the supply unit the positioning device or the stripper element are in the waiting position.

In order to further improve the positioning of the cores at the winding shaft in its accuracy, the winding shaft can be tilted downwards towards the horizontal axis so that the winding shaft is tilted in an angle $\alpha$ towards the horizontal axis wherein particularly the angle is $\alpha \leq 5°$. For example it is possible that the free edge of the winding shaft which is facing the supply unit is tilted downwards. Due to the slightly inclined assembly of the winding shaft towards a horizontal axis or towards the movement direction of the receiving unit the winding shaft passes through the single cores which comprise the form of a hollow cylinder. At the same time a slight contact with the shell surface of the inclined assembled winding shaft and the inner side of the shell surface of the core results, wherein the core or the cores undergo an additional positioning at the winding shaft.

Further the invention is solved by a method according to all features of the independent claim 15. In the dependent claims possible embodiments of the method according to the invention are described.

According to the invention a method for the positioning of cores in a roll handling system is intended with a supply unit in order to transfer a plurality of cores to a receiving unit wherein the receiving unit is assembled movably between the supply unit and a transfer station between the transfer station and the supply unit a positioning device is intended, the receiving unit comprises a first contact surface with positioning means extending protrusion-like from the contact surface, the transfer station comprises a holding device at which a winding shaft is detachably assembled wherein the following steps are involved:

transfer of the cores to the receiving unit so that at least one core is lying on a positioning means wherein the at least one core comprises an inclined state at the contact surface of the receiving unit movement of the receiving in the direction to the transfer station wherein during this movement the positioning device acts on the at least one core and the core leaves the inclined state and is pushed to the contact surface of the receiving unit wherein a first positioning of the at least one core occurs.

Particularly advantageous is that a plurality of cores can be processed by the roll handling system wherein during the movement of the receiving unit all cores are positioned before the cores are further processed outside the transfer station. Further advantages of the method according to the invention correspond with the advantages which already apply for the roll handling system according to the invention.

Further it has been turned out as advantageous that after the first positioning the receiving unit moves further into the direction of the transfer station and the cores are positioned on the inclined winding shaft tilted downwards towards the horizontal axis after a travel of the receiving unit and the winding shaft thereby acts on the cores, which are each positioned at a positioning means of the receiving unit so that the second positioning of the cores occurs. Therewith by the method according to the invention two positioning can occur wherein the quality of positioning of the cores on the winding shaft is improved. Hereby it is advantageous that after the first positioning and/or after the second positioning the cores comprise a distance to one another. The distance can vary according to the requirement profile.

Expediently the method according to the invention comprises that the cores are transferred to the supply unit in a way that the cores roll from the supply unit to the receiving unit and subsequently all cores are assembled next to each other on the receiving unit. The cores advantageously roll independently from one another from the supply unit to the receiving unit wherein previously the receiving unit is assembled in the corresponding rotation position so that the cores reach the first contact surface.

BRIEF DESCRIPTION OF THE SEVERAL VIEWS OF THE DRAWINGS

Further advantages, features and details of the invention result from the subsequent description in which multiple embodiments of the invention are described in detail in correspondence to the drawings. Thereby the described features in the claims and in the description can be essential for the invention each single for themselves or in any combination. It is shown:

FIGS. 1 to 11 show schematically a roll handling system for a winder 50 in which cores 1 can be wound each with a material web 2. Hereby the roll handling system comprises a supply unit 10 in order to transfer a plurality of cores 1 to a receiving unit 20. According to FIG. 1 already three rolls 3 are transferred to the receiving unit 20 wherein the receiving unit 20 comprises a first contact surface 23 on which the cores 1 are applied. The cores 1 are hereby configured cylindrically.

Figure 3:
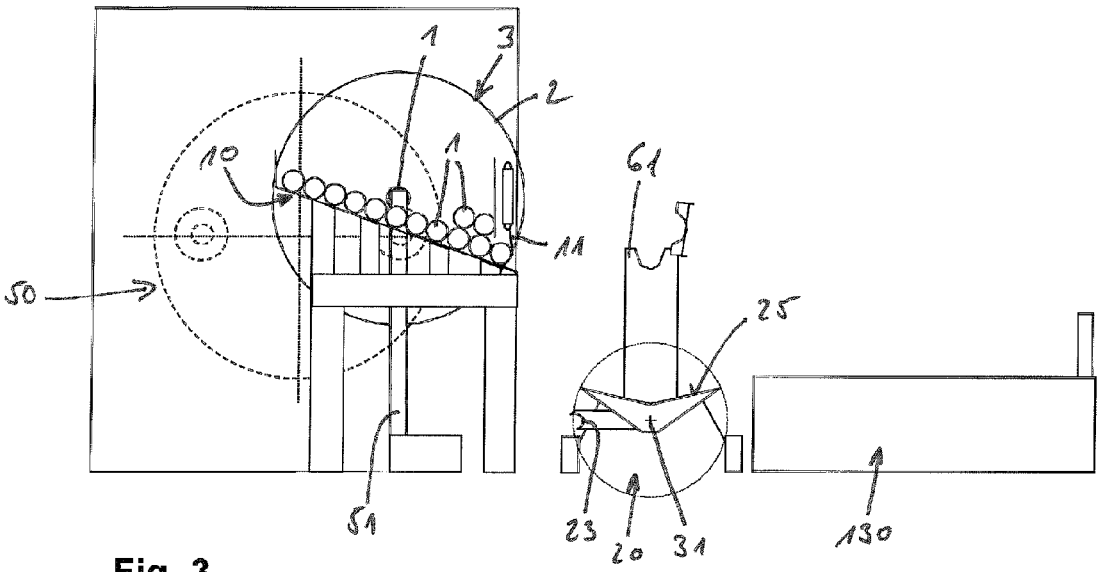
Figure 4:
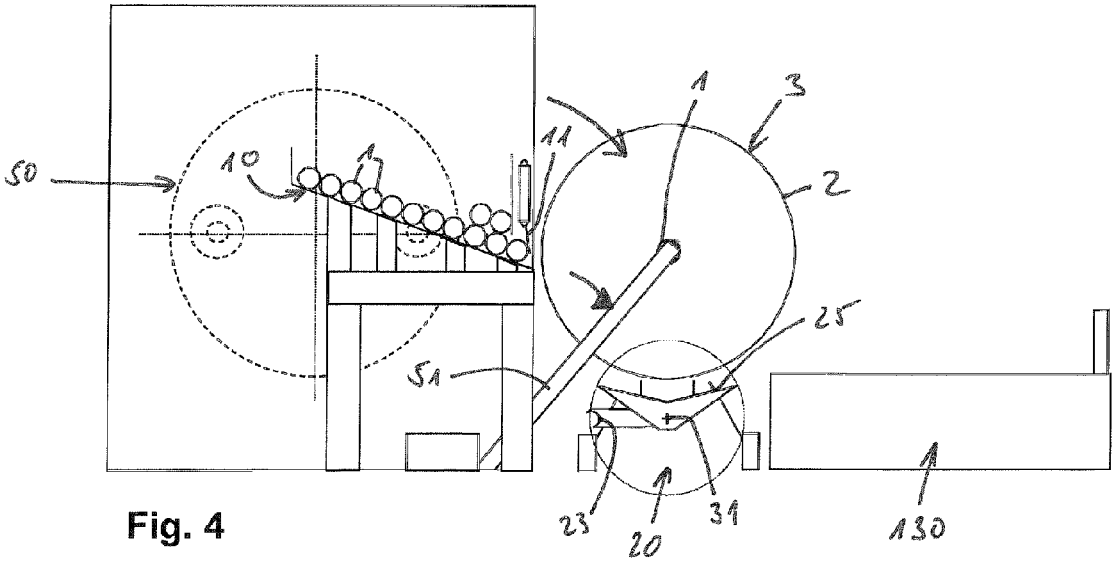
Figure 5:
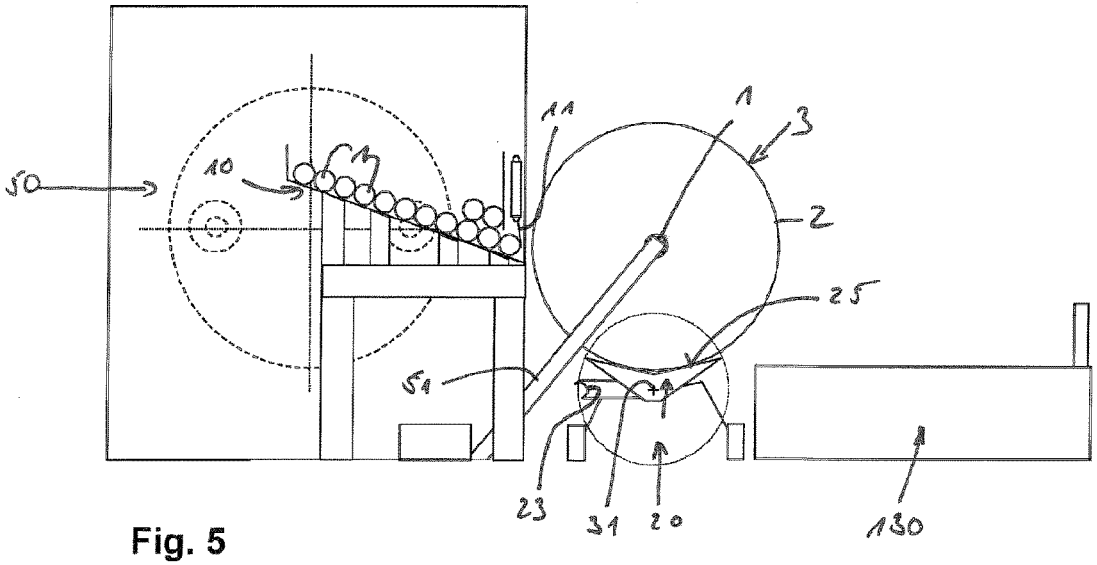

The receiving unit 20 can be moved between a supply unit 10 and a transfer station 60. At the transfer station 60 the cores 1 can be transferred to the winder 50 which will be described subsequently. In the winder 50 on each single core 1 a material web 2 is applied respectively and a plurality of rolls 3 consisting of cores 1 wound with the material web 2 are produced, see for example FIG. 3 and FIG. 6. The rolls 3 are subsequently transferred from the winder 50 to the transfer station 60 which is shown in FIG. 4 and FIG. 5.

Figure 12:
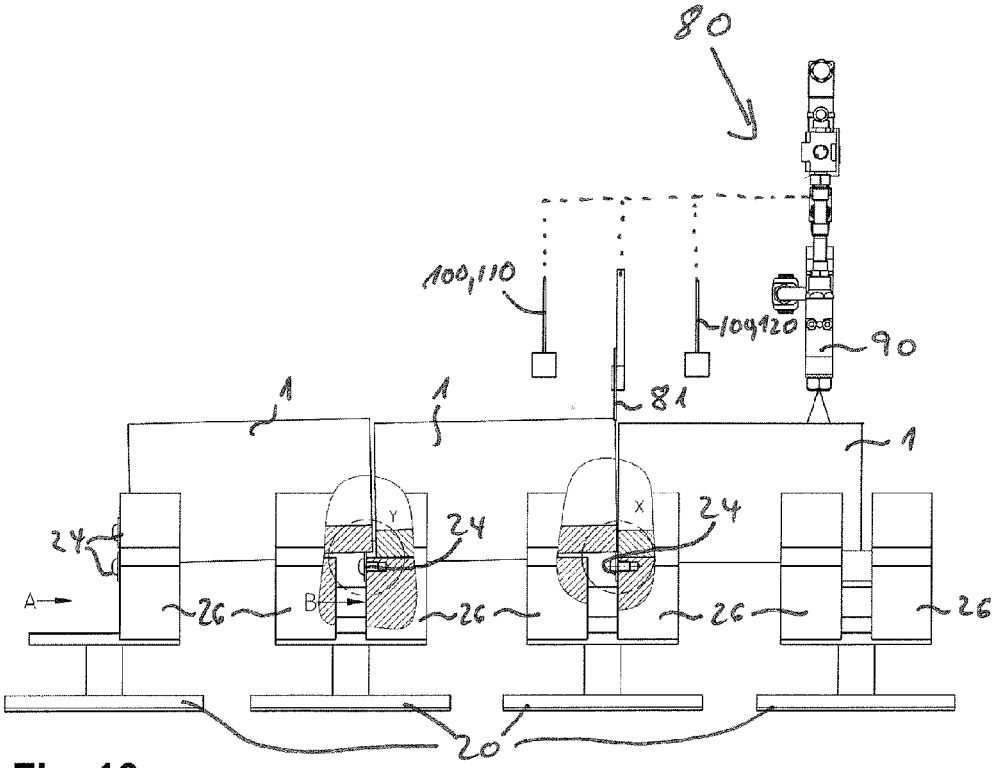

Between the transfer station 60 and the supply unit 10 a positioning device 80 is intended which affects a positioning of the cores 1 on the first contact surface 21 during the movement of the receiving unit 20 in the direction of the transfer station 60. The positioning device 80 is configured in a way that the positioning of the cores 1 occurs towards one another. The positioning device 80 comprises a sensor unit 100 which is shown in FIG. 12 wherein the sensor unit 100 reviews the passing cores 1 in how far the cores 1 are correctly applied to the receiving unit 20 and/or if the correct cores 1 are on the receiving unit 20. According to FIG. 12 the sensor unit 100 comprises a first sensor 110 which reviews in how far the diameter of the core 1 according to a predefined maximum diameter is too large in order to protect the equipment of the roll handling system which is assembled behind it. In case the measured diameter of the core 1 is actually larger than a predefined maximum diameter, a termination of the roll handling system occurs.

The second sensor 120 reviews in how far the actual diameter of the core 1 corresponds to a predefined value within the roll handling system. For example it is possible that the operator of the machine of the roll handling system previously enters the value of the core 1 according to its diameter. Subsequently, via the measurement of the second sensor a comparison between the measured diameter of the core 1 and the previously entered diameter value occurs. The sensor unit 100 which is assembled at the positioning device 80 can further determine in how far a core 1 is missing which likewise leads to a termination of the roll handling system. Between both sensors 110, 120 a stripper element 81 is assembled which is flexible according to the present embodiment and can be configured from a spring sheet. Further the positioning device 80 comprises a gluing device 90 which is assembled in the direction of the transfer station 60.

In FIG. 12 to FIG. 15 it is shown that the receiving unit 20 comprises positioning means 24 in order to align the cores 1 using the positioning device 80 at the receiving unit 20. Hereby the first contact surface 23 of the receiving unit 20 comprises bowl elements 26 which are at least partially adjusted to the geometric form of the cores 1. The bowl elements 26 are spaced apart to one another wherein the positioning means 24 extends protrusion-like from the contact surface 23 which is particularly shown in FIG. 13 to FIG. 15. According to the present embodiment the positioning means 24 are configured disk-like wherein the positioning means 24 are configured as metallic disks which are assembled laterally at the bowl elements 26.

Figure 10:
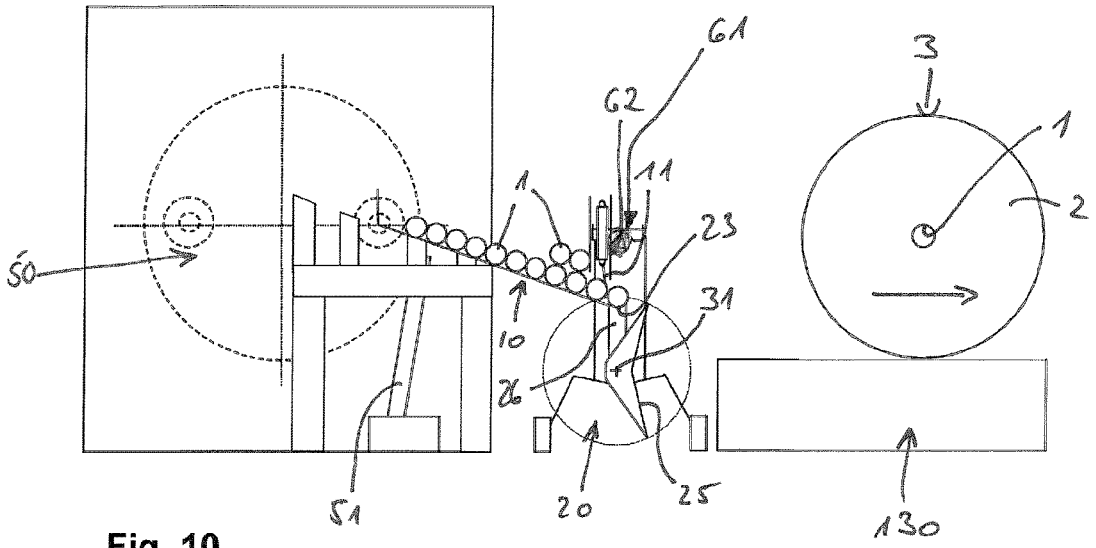
Figure 11:
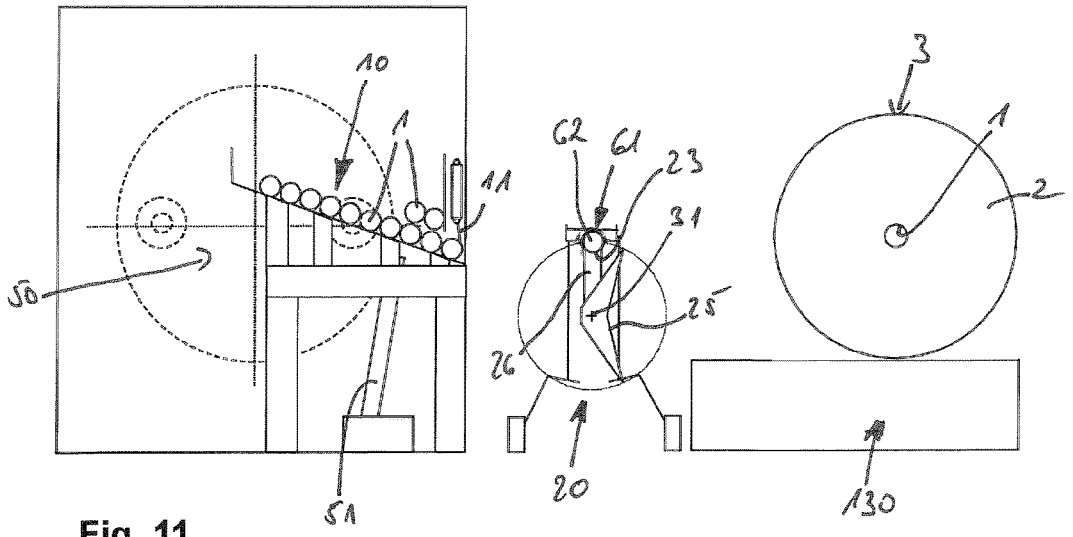
Figure 13A:
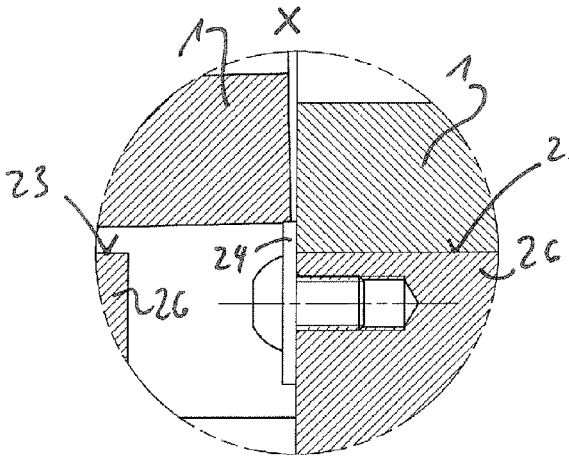
Figure 13B:
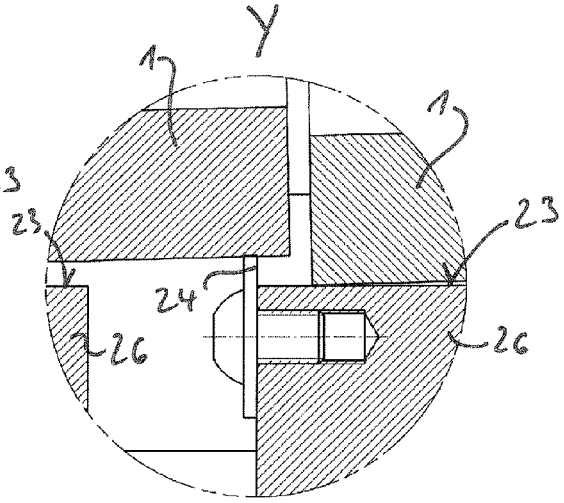
Figure 14:
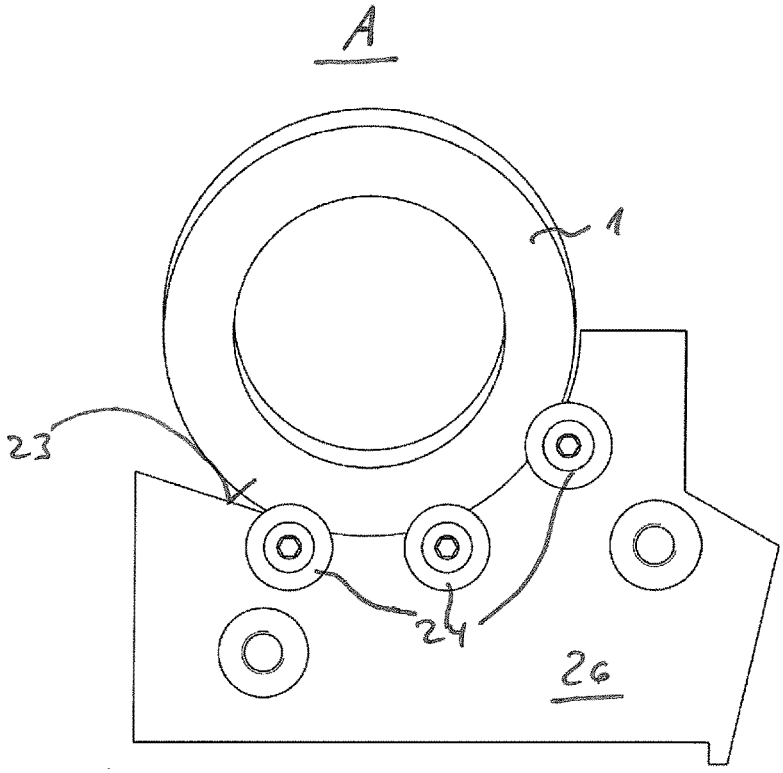
Figure 15:
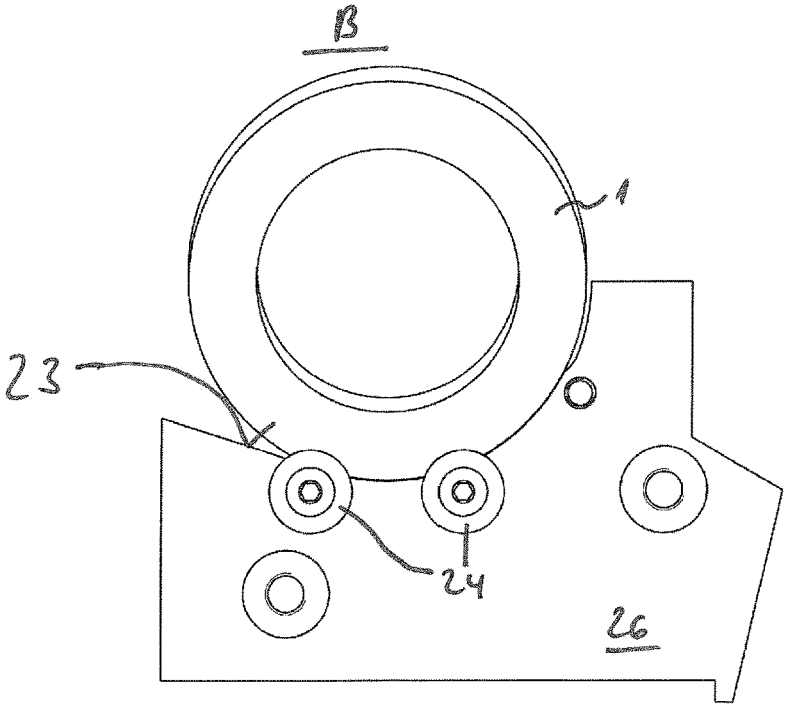

In case the cores 1 are transferred from the supply unit 10 to the receiving unit 20 (see FIG. 10) the cores 1 are according to FIG. 12 on one or multiple positioning means 24 respectively, whereby the cores 1 comprise an inclined state at the first contact surface 23 of the receiving unit 20 which is shown in FIG. 12. If now a movement of the receiving unit 20 occurs from the position according to FIG. 1 in the direction of FIG. 2, the stripper element 81 contacts each inclined assembled core 1 so that the core 1 is turned out of its inclined state and is pushed to the contact surface 23 of the receiving unit 20 wherein a first positioning 5 of the core 1 occurs. According to FIG. 12 the right core 1 is already positioned via the stripper element 81 wherein the core 1 strikes against the positioning means 24 with its left area which is shown in FIG. 13*a*. Therewith also the middle core 1 and the left core 1 are positioned wherein at the same time the receiving unit 20 moves with the cores 1 in the direction of the transfer station 60. At the same time a review of the diameter of the cores 1 occurs via the sensor unit 100. After the first positioning 5 of the cores 1 an application of a glue medium occurs to the shell surface of each core 1 via the gluing device 90. The positioning device 80 can hereby comprise a tempering unit and/or a pressure unit in order to apply the glue medium to the cores 1 according to defined parameters. For example it is possible that the glue medium is a hot melt adhesive. The function of the glue medium is that the material web 2 is reliably assembled at the shell surface of the core 1 within the winder 50.

The bowl element 26*a* according to FIG. 12 comprises two positioning means 24 assembled on one level which serve as a stop for the middle core 1. This is likewise shown in FIG. 15.

The furthest bowl element 26*b* comprises a further positioning means 24 which is elevated towards both positioning means 24. This further security means 24 serves as a security element in order to avoid a tilting during the positioning of the left core 1.

Figure 2:
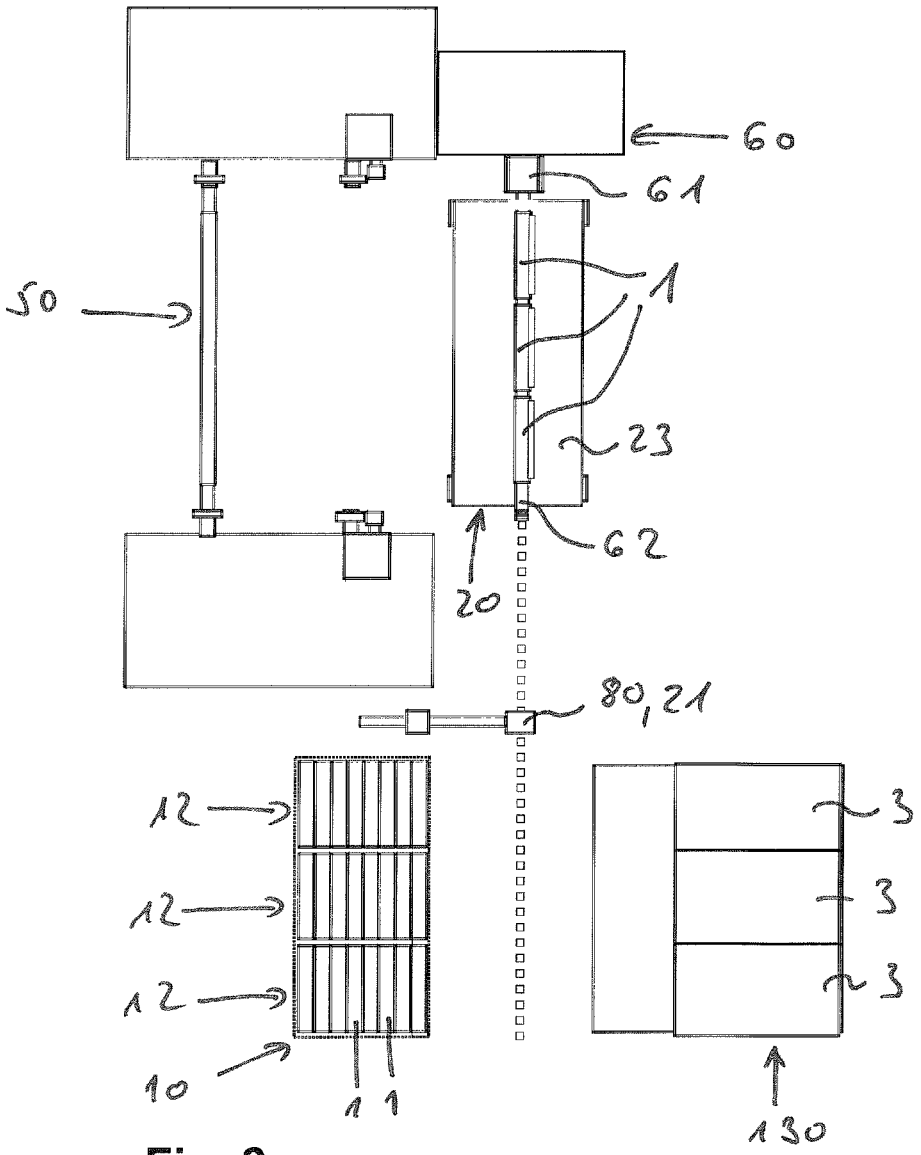
Figure 6:
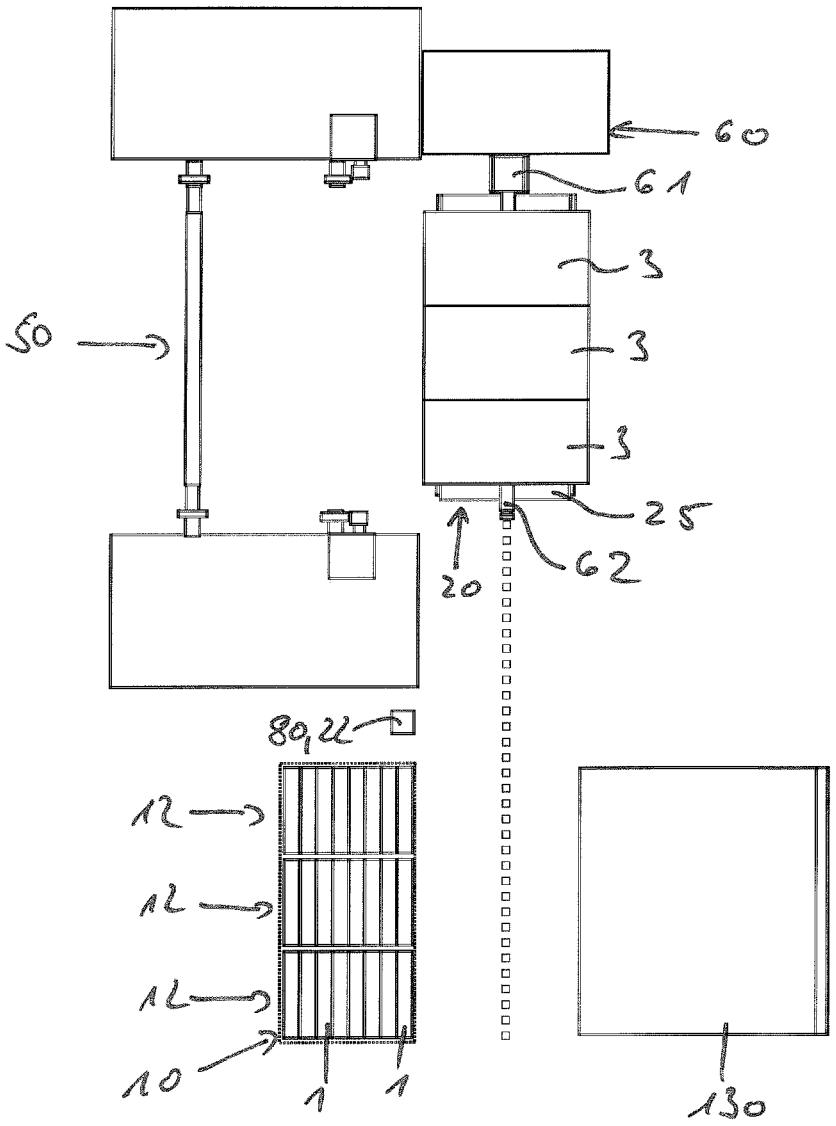
Figure 7:
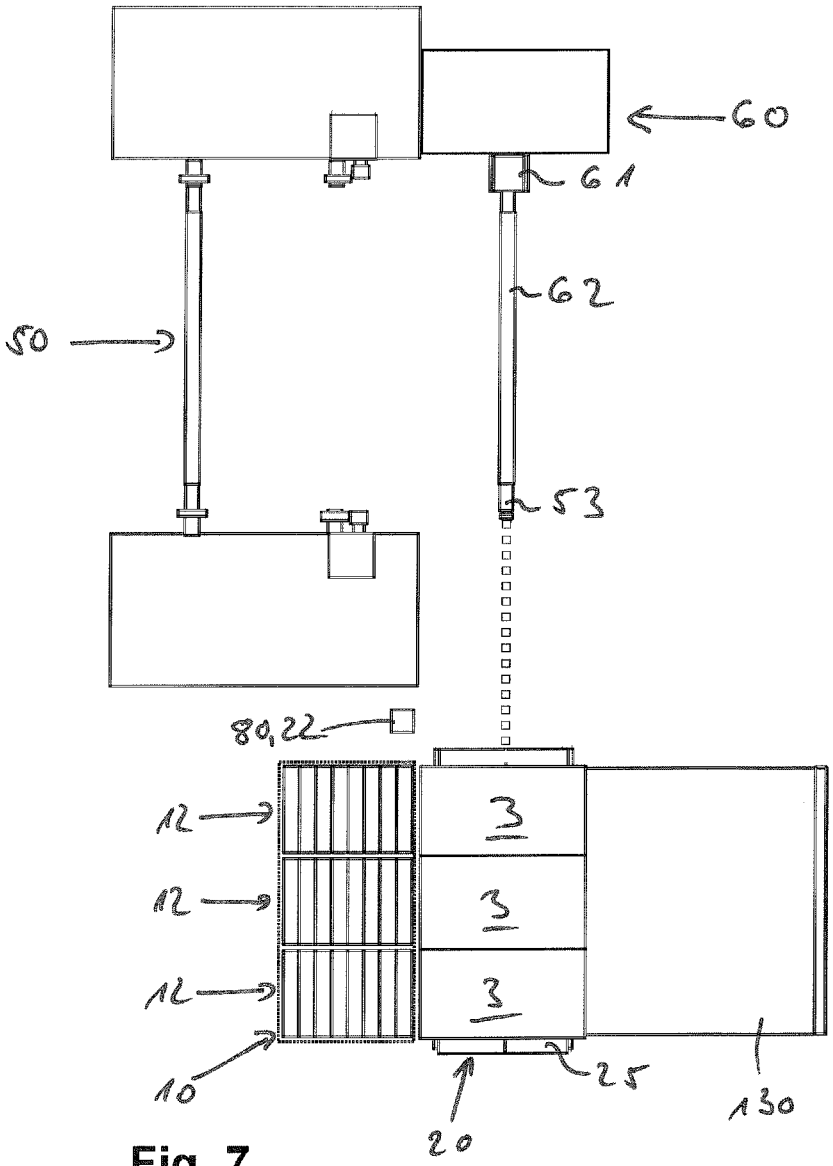

The positioning device 80 at which the gluing device 90 and the sensor unit 100 are integrated can be moved wherein during movement of the receiving unit 20 with the cores 1 in the direction of the transfer station 60 according to FIG. 2, the positioning device 80 takes up a working position 21 which is shown in FIG. 12. The positioning device 80 can be further transferred into a waiting position, which is schematically shown in FIG. 6 and FIG. 7, in which no application of the glue medium and/or the review of the diameter of the cores 1 is necessary.

Figure 16:
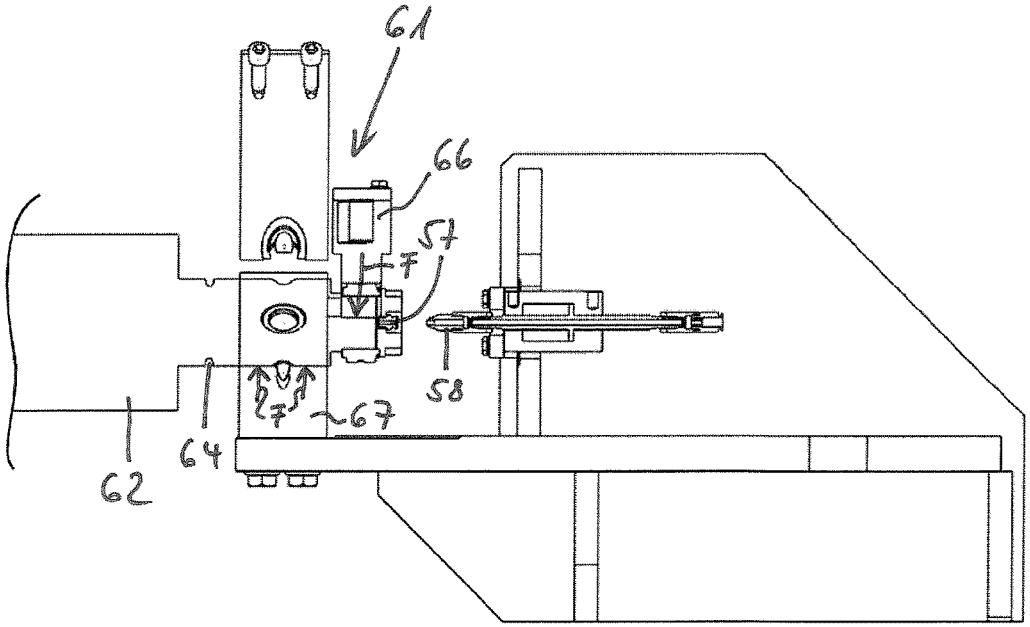
Figure 17:
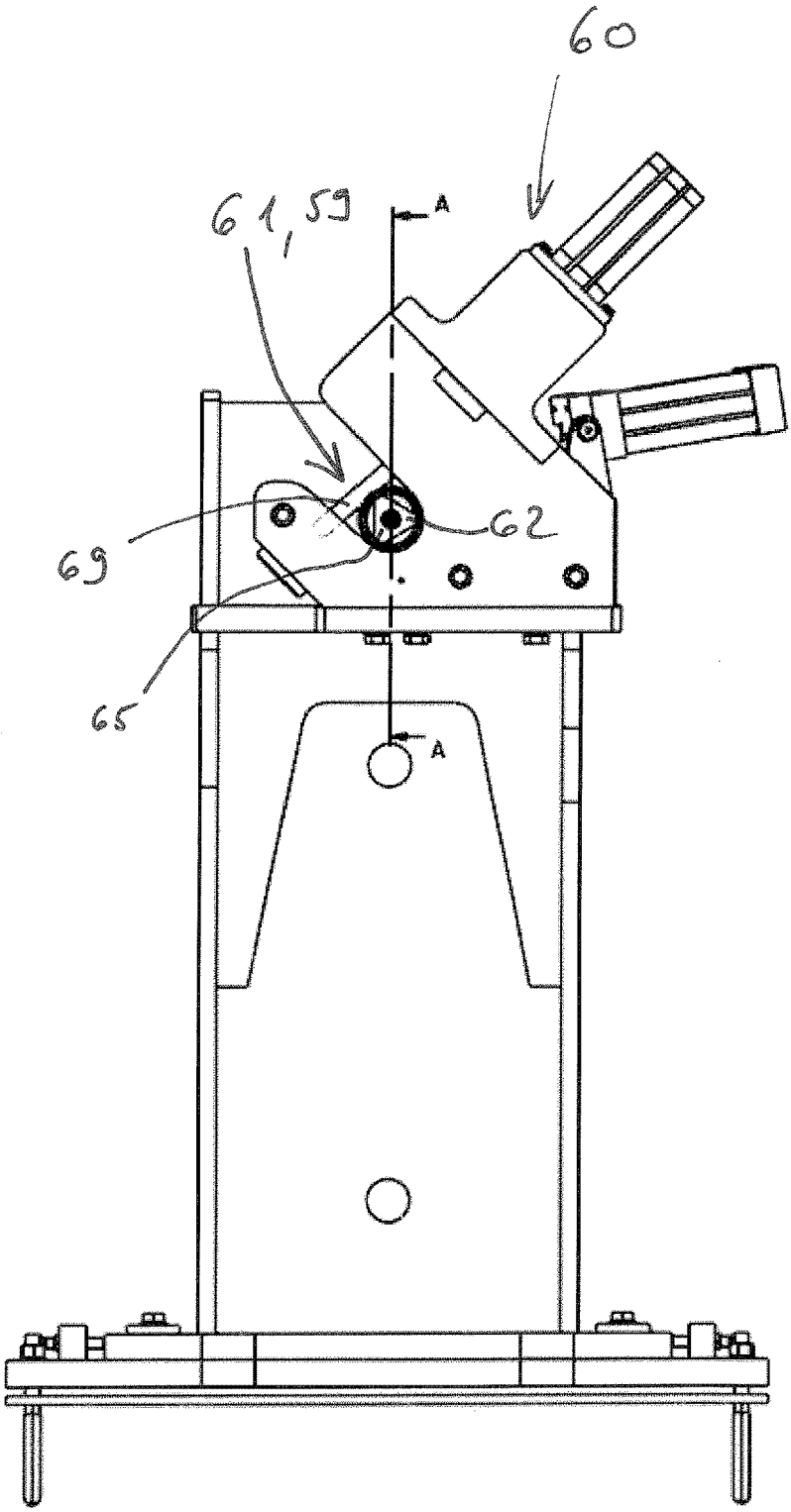
Figure 21:
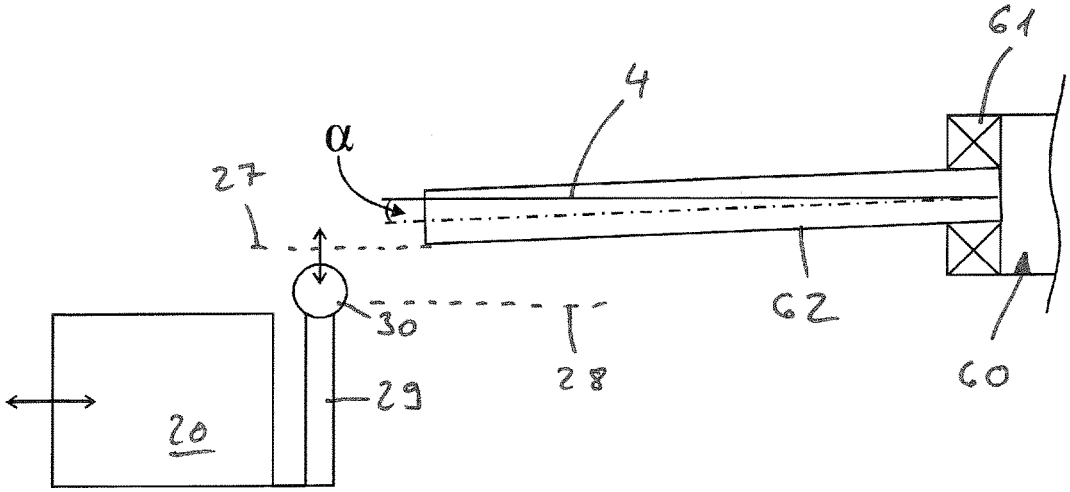

According to FIG. 1 to FIG. 11 the transfer station 60 comprises a holding device 61 at which a winder shaft 62 is detachably assembled. During the movement of the core 1 using the receiving unit 20 in the direction of the transfer station 60 the cores 1 are thread or pushed to the winding shaft 62 so that the cores 1 reach the position in FIG. 2. The winding shaft 62 is mounted and fixed at the holding device 61 on one side, which is shown in FIG. 16, FIG. 17 and FIG. 21. The mounting of the winding shaft 62 is assembled on the side of the holding device 61 which is facing away from the supply unit 10. Hereby, the winding shaft 62 is tilted downwards towards the horizontal axis 4 which is schematically shown in FIG. 21. The winding shaft 62 is tilted in an angle $\alpha$ towards the horizontal axis 4 wherein the angle $\alpha$ is smaller than 5°. The free edge 53 of the winding shaft 62 which is facing the supply unit 10 is tilted downwards. In order that during the movement of the receiving unit 20 in the direction of the transfer station 60 the free edge 53 can retract into the hollow cores 1 a guiding element 29 serves for the fact that for a short time the winding shaft 62 is turned into the horizontal axis 4. The guiding element 29 is assembled at the receiving unit 20 wherein the guiding element 29 can be turned in between an active position 27 and a passive position 28 wherein these positions 27, 28 are schematically shown in FIG. 21. In the active position 27, the guiding element 29 turns the winding shaft 62 into the horizontal axis 4 wherein the winding shaft 62 penetrates into the cores 1. It is sufficient according to the invention that the winding shaft 62 is only partly penetrated into one or multiple cores during the movement of the receiving unit 20 into the direction of the transfer station 60. Subsequently the guiding element 29 can be retracted into the passive position 28 so that the winding shaft 62 moves back in its tilted position. Hereby a certain friction is generated with the inner shell surface of the core 1 wherein the receiving unit 20 moves further into the direction of the transfer station 60 with the cores 1. The winding shaft 62 thereby acts on the cores 1 so that the cores 1 are end positioned, each at the positioning means 24 of the receiving unit 20, which is a second positioning 6 of the cores 1 at the first contact surface 23. Hereby the cores 1 are pushed against the respective positioning means 24 so that each core 1 is in contact with its positioning means 24 which corresponds to FIGS. 14 and 15.

According to FIG. 21 the guiding element 29 is configured with a roller element 30 which is rolled in the active position 27 at the winding shaft 62. Hereby a minimal friction can be achieved by which hardly any noise pollution is registered. The roller element 30 can be configured from a suitable plastic.

Figure 18:
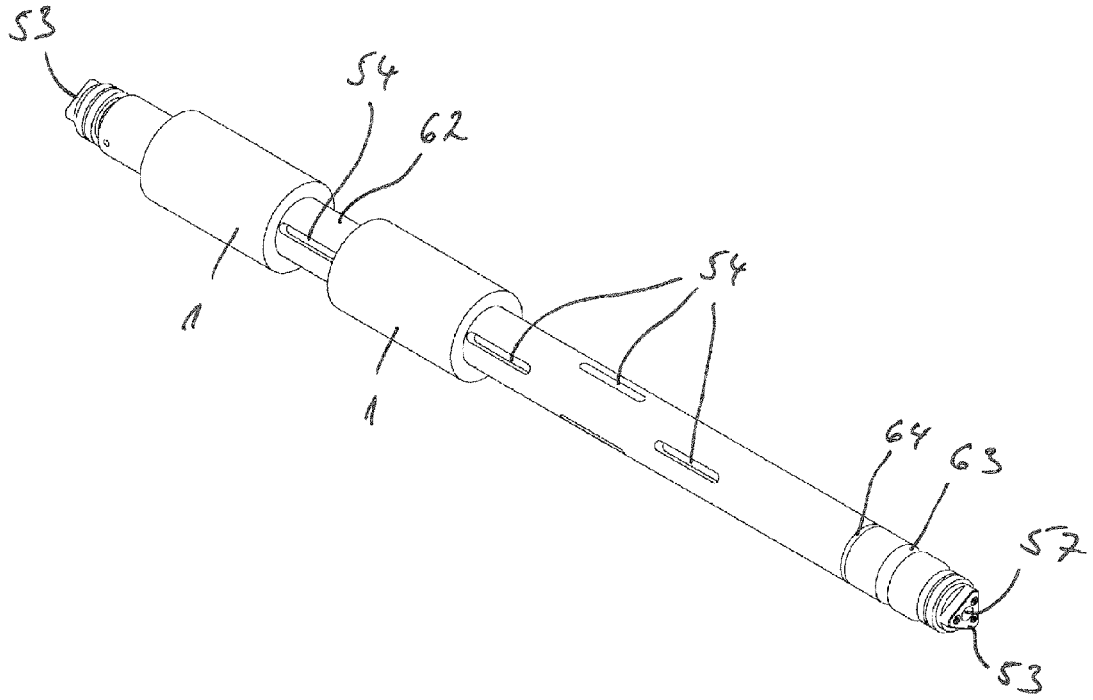
Figure 19:
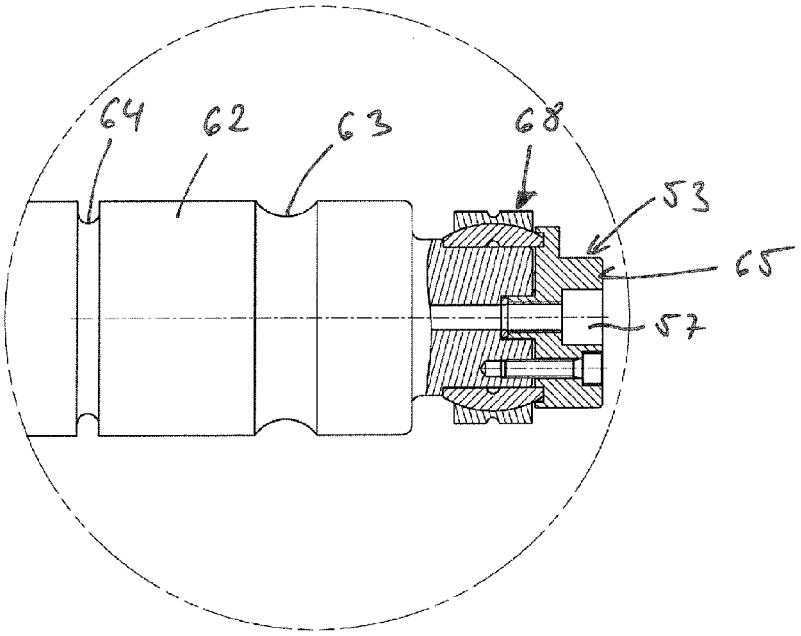
Figure 20:
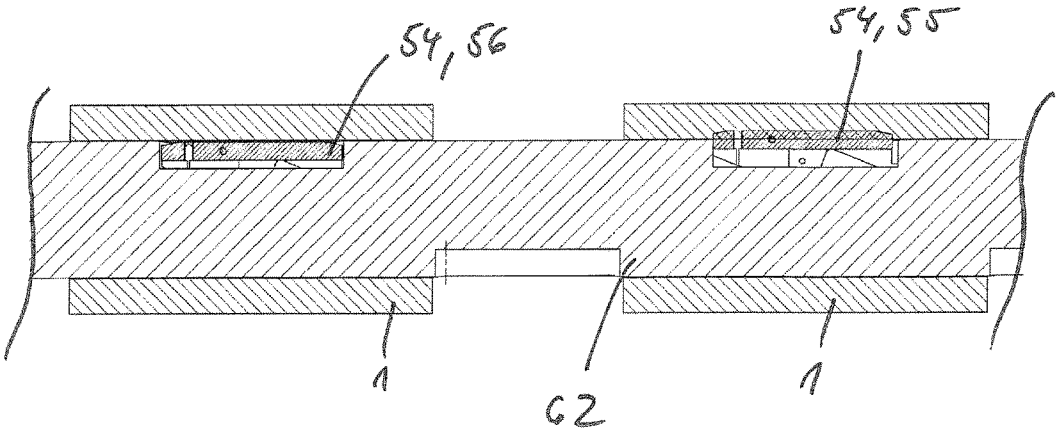

In order that the cores 1 remain fixed on the winding shaft 62, particularly also within the winder 50, the winding shaft 62 comprises fixation means 54 which are shown in FIG. 18 and FIG. 20. According to the shown embodiments the fixation means 54 are configured as movable clamping elements at the winding shaft 62 which are movable between an extended state 55 and a retracted state 56. In the extended state 55 a fixation of the cores 1 at the winding shaft 62 occurs wherein the clamping elements 54 extend protrusion-like from the winding shaft 62 in the extended state 55 and therewith fit to the inner shell surface of each core 1 with a defined force. Hereby, additionally a centralization of the cores 1 at the winding shaft 62 occurs since particularly, like shown in FIG. 18, the fixation means 54 are assembled evenly about the shell surface of the winding shaft 62. During the transfer of the winding shaft 62 with the cores 1 to the winder 50 and back from the winder 50 in the direction of the transfer station 60, the fixation means 54 are in their extended state 55. The drive for moving the clamping elements 54 in their respective state 55, 56 occurs in the present embodiment via air which is introduced into the winding shaft 62 via an air inlet 57, which is schematically shown in FIG. 19. The air inlet 57 is assembled axially to the winding shaft 62. The air is introduced, according to FIG. 16, via a nozzle 58 wherein the nozzle 58 is initially moved into the air inlet 57. Via the adjusting pressure within the winding shaft 62 the clamping elements 54 move into the defined extended state 55. Before the winding shaft 62 is transferred to the winder 50 the nozzle 58 which is assembled at the transfer station 60 retracts in the position shown in FIG. 16. A not explicitly shown non-return valve avoids that the fixation means 54 leave the extended state 55.

According to FIG. 16 and FIG. 17 further the holding device 61 is shown at the transfer station 60 which has a movable bolt 69 which serves as an axial security for the winding shaft 62 in case when the winding shaft 62 is in the holding device 61 of the transfer station 60. Particularly during pulling out of the rolls 3 from FIG. 6 into the direction of the supply unit 10 according to FIG. 7, intense forces can act on the winding shaft 62. The axial security 60 is in a fixed position 59 (see FIG. 17) wherein in the fixing position 59 the axial security 60 is in an acceptance 63 according to FIG. 18. The acceptance 63 is configured as a groove in the winding shaft 62 according to the shown embodiment.

Beneath the axial security 60 the holding device 61 comprises retaining plates 66, 67 which act within the sense of a knee lever with a defined force to the winding shaft 62 which is shown schematically in FIG. 16. Hereby it is achieved that the winding shaft 62 is assembled at one side of the transfer station 60. According to FIG. 19 the winding shaft 62 comprises a further acceptance 64 which is assembled neighboring to the first acceptance 63 wherein the further acceptance 64 can be brought into a grab element 51 of the winder 50 which is shown schematically in FIG. 3 to FIG. 5. The further acceptance 54 is likewise configured as a groove wherein the grab element 51 is configured according to the geometry of the acceptance 64 and engages into this acceptance 64 when the winding shaft 62 is moved from the transfer station 60 in the winder 50 and back from the winder 50 into the transfer station 60. During the transfer the previously described holding device 61 is detached so that the axial security 60 is detached from the winding shaft 62. This means that the axial security 60 does not take over the fixing position 59 but it is in a not explicitly shown release position in which the bolt 69 is positioned spaced apart from the winding shaft 62. Also the retaining plates 66, 67 are not fitting to the winding shaft 62. The winding shaft 62 is only retained by grip element 51.

Figure 8:
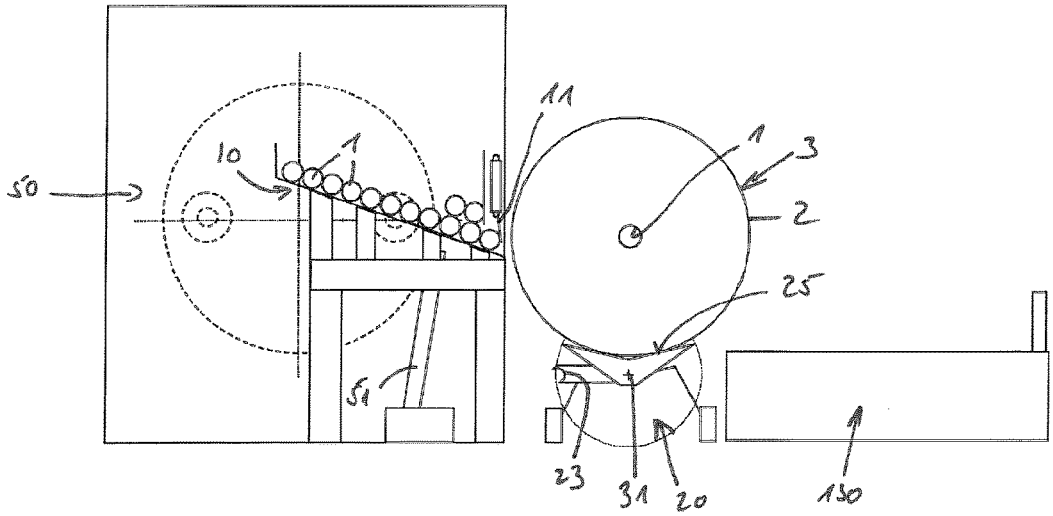
Figure 9:
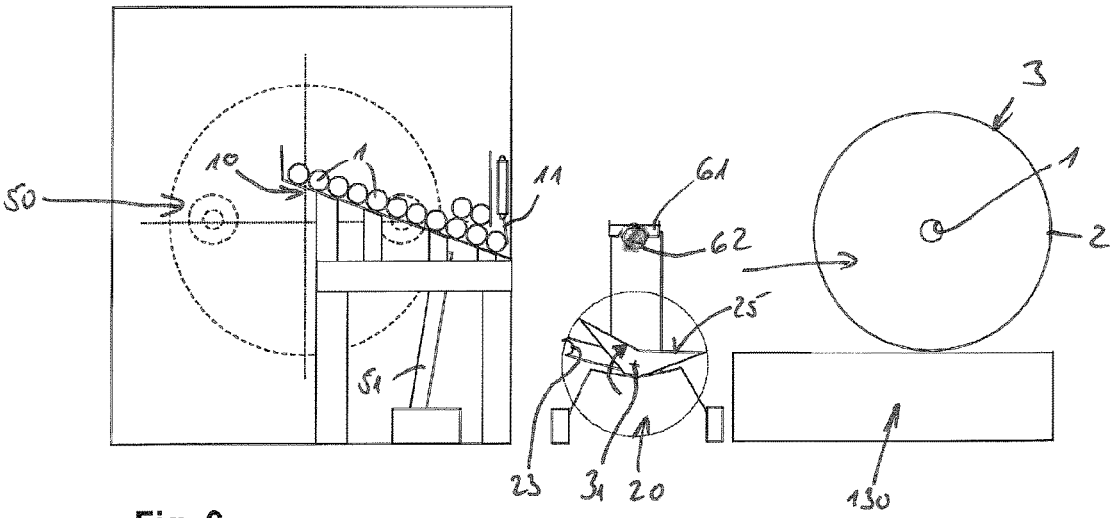

If now the rolls 3 according to FIG. 4 are transferred at the transfer station 60 a ventilation of the winding shaft 62 occurs by which the clamping elements 54 move in a retracting state 56 due to the outlet of air from the winding shaft 62. The receiving unit 20 moves as far as to the rolls 3 until a contact with the material web 2 is established. When the rolls 3 reliably lie on the receiving unit 20 the axial security 60 is turned in its fixing position 59 and the retaining plates 66, 67 move in their holding position according to FIG. 16 in which the winding shaft 62 is kept and fixed in the holding device 61. The grab elements 51 which are movably assembled at the winder 50 can detach from the winding shaft 62 and move in a position which is shown in FIG. 8.

In order that the rolls 3 can be reliably received from the receiving unit 20 the receiving unit 20 comprises a second contact surface 25 which can be moved independently from the receiving unit 20 according the shown embodiment.

Although the receiving unit 20 maintains its position according to FIG. 4, the receiving unit 20 comprises a lifting device for the second contact surface 25 which can move the second surface 25 from its position according to FIG. 4 in the direction of the roll 3 according to FIG. 5 until the roll 3 is resting reliably on the second contact surface 25. The advantage of two configured contact surfaces 23, 25 varying in their size and form is that the geometry of the cores 1 and the rolls 3 are different. Further, the weight of the rolls 3 is significantly enlarged compared to the weight of the core 1. It is particularly advantageous that the receiving unit 20 can be assembled rotating about an axis 31, wherein in a rotation stage the first contact surface 23 is active in order to receive the cores 1 for example in FIG. 10. Hereby the second contact surface 25 is inactivated and without any function. In a further rotational stage of the receiving unit 20 the second contact surface 25 is active, which is for example shown in FIG. 5, in order to reliably receive the rolls 3. Hereby the first contact surface 23 is inactive.

According to FIG. 19 it is further shown that the air inlet 57, which can at the same time also serve as an air outlet during ventilation is assembled at the front surface 65 of the winding shaft 62. Hereby the front surface 65 is configured as a triangle like shown in FIG. 18. The triangle has the advantage that within the winder 50 high torque values can be received.

According to the shown embodiment in FIG. 19 the winding shaft 62 comprises a tilting protection which is realized in form of a spherical bearing which is movably assembled at the edge of the winding shaft 62. The spherical bearing 68 is configured from a plastic and can avoid that a tilting of the winding shaft 62 arises when the winding shaft 62 is deflected.

If now the receiving unit 20 with the rolls 3 has reached the position according to FIG. 7, the receiving unit 20 is rotating about the axis 31. Particularly, the second contact surface 25 moves about the axis 31 wherein the rolls 3 are guided to a roller guidance 130 (see FIG. 9). The next cycle for the core supply starts wherein, according to FIG. 10, the supply unit 10 approaches to the receiving unit 20 and further cores 1 are supplied to the first contact surface 23. The supply unit 10 comprises a separating element 11 which serves for the fact that only one core 1 is supplied to the receiving unit 20 from a channel 12 of the supply unit 10. Advantageously all aggregates of the roll handling system are electronically connected to one another via a control unit, particularly the supply unit 10, the separating elements 11, the receiving unit 20 with their contact surface 23, 25, guidance element 29, transfer station 60, holding device 61, fixation means 54, axial security 60, retaining plates 66, 67, positioning device 80 and roller guidance 130 so that the data transfer can occur among one another. Hereby, the roll handling system can be further optimized in its efficiency. Likewise the winder 50 can be in data communication with the control unit, particularly the control unit can be integrated in the winder 50. Further the supply unit 10 is configured in a way that the channels 12, according to FIG. 1 or FIG. 2, are adjustable in their width according to the geometry of the cores 1 particularly it is possible that the supply unit 10 is configured in a way that the channel amount can be varied.

Figure 1:
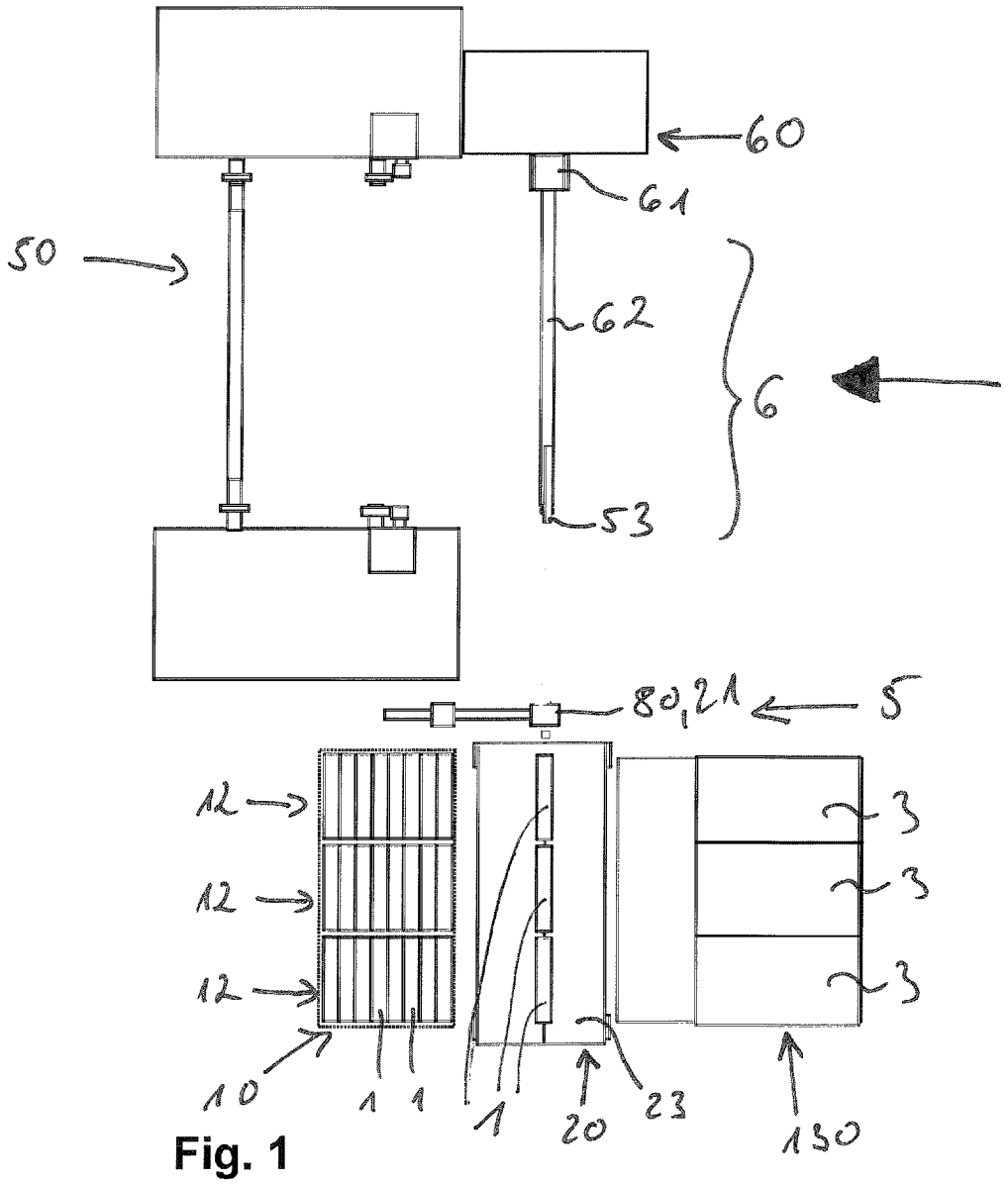
FIGS. 1, 2, 3, 4, 5, 6, 7, 8, 9, 10 and 11 schematic views of a roll handling system with a winder, a supply unit, a receiving unit, a transfer station, a positioning device and a roller guidance, wherein the roll handling system is in different operating states, FIG. 12 a detailed view of the positioning device, FIGS. 13*a* and 13*b* an enlarged view according to FIG. 12, FIG. 14 a view A according to FIG. 12, FIG. 15 a view B according to FIG. 12, FIG. 16 a detailed view of the transfer station, FIG. 17 a further view of the transfer station, FIG. 18 a three-dimensional view to a winding shaft of the roll handling system, FIG. 19 an enlarged view of a part of the winding shaft according to FIG. 18, FIG. 20 a sectional view of the winding shaft according to FIG. 18, and FIG. 21 a schematic view to the winding shaft and the receiving unit assembled in the transfer station.

The shown embodiment of the roll handling system is particularly advantageous since due to the assembly of the single aggregates the winder 50 is accessible and visible for the operator which is shown by an arrow according to FIG. 1. This is among others achieved by the fact that the retaining device 61 is assembled laterally on the opposing side of the supply unit 10 or the roller guidance 130 wherein the winding shaft 62 is detachably attached on one side of the retaining device 61.

During the assembly of the material web 2 to the cores 1 in the winder 50 a roll 3 results with each a material web 2, wherein the material webs 2 are applied to different cores 1, which are assembled next to one another. Subsequently the rolls 3 are reguided to the transfer station 60. Until the material web 2 is applied to the core 1, the material web 2 advantageously comprises a bigger width related to the extension direction of the core 1. The raw material web, which is not explicitly shown, is separated in the single material webs 2 in a previous step, wherein a cut with a blade or a cut with a disk knife can occur. The step for separating can for example occur within the winder 50.

The grab elements 51 which act laterally at the winding shaft 62 can extend and retract translationally in their length and swivel about a defined axis which is schematically shown in FIG. 3 to FIG. 5 or FIG. 8. Hereby the winding shaft 62 can be accurately positioned.

LIST OF REFERENCE NUMBERS

1 Core
2 Material web
3 Roll
4 Horizontal axis
5 First positioning
6 Second positioning
10 Supply unit
11 Separating element
12 Channel
20 Receiving unit
21 Working position
22 Waiting position
23 First contact surface
24 Positioning means
25 Second contact surface
26 Bowl element
27 Active position
28 Passive position
29 Guidance element
30 Roll element
31 Axis of the receiving unit
50 Winder
51 Grab element
53 Free edge
54 Fixation means/clamping element
55 Extended state
56 Retracted state
57 Air inlet/air outlet
58 Nozzle
59 Fixing position
60 Transfer station
61 Holding device
62 Winding shaft
63 Acceptance
64 Acceptance
65 Front surface
66 Retaining plate
67 Retaining plate
68 spherical bearing
69 Bolt axial fastening
80 Positioning device
81 Stripper element
90 Gluing device
100 Sensor unit
110 First sensor
120 Second sensor
130 Roller guidance

What is claimed is:

1. A Roll handling system for a winder in which cores received from a supply unit wind with a material web to produce a plurality of rolls consisting of the cores in order to transfer the plurality of cores to a receiving unit, wherein the receiving unit is movably assembled between the supply unit and a transfer station with which the cores are transferable to the winder and rolls are transferable from the winder to the transfer station;

wherein the receiving unit comprises a first contact surface with positioning means in order to align the core at the receiving unit via a positioning device assembled between the supply unit and the transfer station;

wherein the receiving unit is linear movable between the supply unit and the transfer station or comprises a lifting device, wherein the receiving unit is movable perpendicular to the movement direction between the supply unit and the transfer station.

2. Roll handling system according to claim 1 wherein the first contact surface comprises bowl elements which are at least partially adjusted to a geometric form of the cores.

3. Roll handling system according to claim 2, wherein the bowl elements are spaced apart from one another.

4. Roll handling system according to claim 1 wherein the positioning means are extending as a protrusion from the bowl element and/or from the contact surface.

5. Roll handling system according to claim 1 wherein the positioning means are formed as a disk.

6. Roll handling system according to claim 1 wherein characterized in that the positioning means are assembled laterally at the bowl element.

7. Roll handling system according to claim 1 wherein the receiving unit comprises a second contact surface in order to receive the rolls.

8. Roll handling system according to claim 1, wherein the receiving unit is assembled rotatable about an axis.

9. Roll handling system according to claim 1 wherein the positioning device is configured in a way that a positioning of the cores occurs contiguously.

10. A Roll handling system for a winder in which cores received from a supply unit wind with a material web to produce a plurality of rolls consisting of the cores in order to transfer the plurality of cores to a receiving unit, the receiving unit is movably assembled between the supply unit and a transfer station with which the cores are transferable to the winder and rolls are transferable from the winder to the transfer station;

wherein the receiving unit comprises a first contact surface with positioning means in order to align the core at the receiving unit via a positioning device assembled between the supply unit and the transfer station;

wherein the receiving unit comprises a guidance element which can be assembled between an active and a passive position, wherein during the movement of the receiving unit in the direction of the transfer station the guidance element is movable from the passive position into the active position in order to position a winding shaft assembled at the transfer station (60).

11. Roll handling system according to claim 10, wherein the guidance element comprises a roll element which rolls at the winding shaft in the active position of the guidance element.

12. Roll handling system according to claim 10 wherein the winding shaft is tilted downwards towards the horizontal axis so that the winding shaft is tilted in an angle $\alpha$ towards the horizontal axis.

13. Roll handling system according to claim 10 wherein a free edge of the winding shaft which is facing the supply unit is tilted downwards.

14. Roll handling system according to claim 10, wherein the guidance element contacts the winding shaft in the active position and/or shifts the winding shaft in a defined position.

15. A Roll handling system for a winder in which cores received from a supply unit wind with a material web to produce a plurality of rolls consisting of the cores in order to transfer the plurality of cores to a receiving unit, the receiving unit is movably assembled between the supply unit and a transfer station with which the cores are transferable to the winder and rolls are transferable from the winder to the transfer station;

wherein the receiving unit comprises a first contact surface with positioning means in order to align the core at the receiving unit via a positioning device assembled between the supply unit and the transfer station;

wherein the positioning device comprises a stripper element which serves for contacting with at least one core during the movement of the receiving unit in the direction of the transfer station.

16. Method for positioning of cores in a roll handling system, with a supply unit in order to transfer a plurality of cores to a receiving unit, wherein the receiving unit is movably assembled between the supply unit and a transfer station, between the transfer station and the supply unit a positioning device is provided, the receiving unit comprises a first contact surface with positioning means extending as a protrusion from the contact surface, the transfer station comprises a holding device, which is directly assembled at a winding shaft, wherein the following steps are comprised:

transfer of the cores to the receiving unit so that a least a core is applied on a positioning means, wherein the at least one core comprises an inclined state at the contact surface of the receiving unit, movement of the receiving unit in the direction of the transfer station wherein during this movement the positioning device acts on the at least one core and the core leaves the inclined state and is pushed on the contact surface of the receiving unit, wherein a first positioning of the at least one core occurs.

17. Method according to claim 16, wherein after the first positioning of the at least one core occurs the receiving unit moves further in the direction of the transfer station and the cores are pushed to the winding shaft which is tilted downwards towards the horizontal axis after a travel of the receiving unit and the winding shaft thereby acts on the cores which each are positioned at a positioning means of the receiving unit so that a second positioning of the cores occurs.

18. Method according to claim 16, wherein after the first positioning of the at least one core occurs and/or after the second positioning the cores occurs, the cores are spaced apart to one another.

19. Method according to claim 16, wherein the cores are transferred to the supply unit in a way that the cores roll from the supply unit to the receiving unit and subsequently all cores are assembled next to one another in the receiving unit.

20. A Roll handling system for a winder in which cores received from a supply unit wind with a material web to produce a plurality of rolls consisting of the cores in order to transfer the plurality of cores to a receiving unit, the receiving unit is movably assembled between the supply unit and a transfer station with which the cores are transferable to the winder and rolls are transferable from the winder to the transfer station;

wherein the receiving unit comprises a first contact surface with positioning means in order to align the core at the receiving unit via a positioning device assembled between the supply unit and the transfer station;

wherein the receiving unit comprises a second contact surface in order to receive the rolls;

wherein the second contact surface is movable independently from the receiving unit.

* * * * *